United States Patent [19]

Foote

[11] 4,098,016

[45] Jul. 4, 1978

[54] AUTOMATIC AND SEMIAUTOMATIC SMALL CALIBER CONVERSION SYSTEM

[75] Inventor: John P. Foote, Marietta, Ga.

[73] Assignee: U.S. Armament Corporation, Gretna, La.

[21] Appl. No.: 627,743

[22] Filed: Oct. 31, 1975

[51] Int. Cl.[2] ..... F41C 11/00

[52] U.S. Cl. ..... 42/16; 42/49 A

[58] Field of Search ..... 42/16, 49 A, 69 B, 77; 89/29, 138

[56] References Cited

U.S. PATENT DOCUMENTS

| | | | |
|---|---|---|---|
| 639,421 | 12/1899 | Mauser | 42/69 B |
| 1,291,689 | 1/1919 | Sheppard | 89/138 |
| 2,321,045 | 6/1943 | Roemer | 89/138 |
| 2,901,853 | 9/1959 | Fontvieille | 42/69 B |
| 3,771,415 | 11/1973 | Into et al. | 42/49 A |
| 3,776,095 | 12/1973 | Atchisson | 42/49 A |

FOREIGN PATENT DOCUMENTS

| | | | |
|---|---|---|---|
| 1,166,052 | 3/1964 | Fed. Rep. of Germany | 42/49 A |

OTHER PUBLICATIONS

U.S. Armament Corporation Unsolicited Proposal for 22 Rim Fire Adapter, May 26, 1977.

*Primary Examiner*—Charles T. Jordan

*Attorney, Agent, or Firm*—C. Emmett Pugh & Associates, Ltd.

[57] ABSTRACT

An automatic and semiautomatic small caliber conversion system for automatic or semiautomatic shotguns and rifles such as, for example, M-16 and AR-16 rifles, including a uniquely designed three element structure and associated ammunition feeding means to permit the use of smaller caliber, inexpensive ammunition in rifles and shotguns designed originally for larger caliber ammunition. The system includes a bolt/receiver assembly which easily replaces the bolt carrier of the, for example, M-16 rifle, and a magazine assembly which can be inserted by hand into any standard, for example, 0.223 round M-16 magazine. The bolt/receiver assembly is made up of three sub-assemblies, a receiver, a bolt, and a recoil spring. The receiver sub-assembly includes a section of a circle with a short barrel section in the front which fits into the M-16 chambers, a receiver lug at top rear to locate it within the M-16 chamber and prevent its rotary or linear motions and a guide rail. The bolt subassembly is cylindrical in shape, is guided by the adapter receiver guide rail and is encompassed by the M-16 receiver so that its only free movement is front to rear for ejecting and chambering cartridges. The recoil spring sub-assembly consists of a guide rod and spring. The spring is to return the bolt to battery after firing and also to hold the guide rod into a hole in the receiver lug. The recoil spring subassembly holds the receiver and bolt together as an assembly.

3 Claims, 14 Drawing Figures

AUTOMATIC AND SEMIAUTOMATIC SMALL CALIBER CONVERSION SYSTEM

BACKGROUND OF THE INVENTION

1. Field of the Invention

The present invention relates to an automatic and semiautomatic caliber conversion system for easy conversion of, for example, an M-16 or AR-15 rifle for the use of smaller caliber ammunition. The present invention has been found to be particularly useful in the conversion of M-16 and AR-15 rifles, and hence will be discussed with particular reference thereto. However, the present invention is applicable to other types of rifles and shotguns as well requiring caliber conversion for use in an automatic or semiautomatic mode.

2. Description of the Prior Art

When an automatic or semiautomatic rifle or shotgun using a high caliber ammunition is to be used for training purposes and exercises involving fire control and distribution, as well as for use in indoor ranges, there is a necessity for economical measures for ammunition, as well as permit the obtaining of proper sight pictures and alignment without fear of recoil of the weapon, and protecting instructors from hearing loss associated with continuous exposure to muzzle blast and use on indoor ranges. To this end, many types of caliber adjusters have been developed.

Automatic weapons are well known in the prior art. See for example U.S. Pat. No. 1,563,675, issued Dec. 1, 1925, to G. H. Tansley.

The conversation of magazines for smaller caliber ammunition is also well known in the art. See for example the following U.S. patents:

| Pat. No. | Date Issued | Inventor |
|---|---|---|
| 1,407,633 | Feb. 21, 1922 | F. F. Durton |
| 2,296,729 | Sep. 22, 1942 | I. O. Mossberg |
| 2,396,816 | Mar. 19, 1946 | J. L. Boudreaux |
| 3,772,812 | Nov. 20, 1973 | R. W. Day |

None of these devices however teaches the use of an insertable clip used with high caliber rifles or shotguns. Therefore, they require more exact machining and complexity to mate with the rifle or shotgun.

The conversion of the appearance of the rifle to look like another is also well known in the art. See for example U.S. Pat. No. 3,611,607, issued Oct. 12, 1971 to T. Donnell.

The conversion of cartridges themselves so that no adapter is needed for the rifle or shotgun is also well known in the art. See for example U.S. Pat. No. 3,498,053, issued Aug. 10, 1971, to Irving W. Glater.

It is also well known in the art to adapt single shot rifles, pistols, and shotguns, using other blank cartridges or smaller caliber cartridges. See for example U.S. patents:

| Pat. No. | Date Issued | Inventor |
|---|---|---|
| 3,645,027 | June 10, 1970 | H. C. Palmer |
| 2,608,860 | June 16, 1953 | J. M. Dial |
| 3,138,889 | June 30, 1964 | L. F. Groover |
| 3,364,608 | Jan. 23, 1968 | O. Edstrom |
| 2,423,471 | July 8, 1947 | W. Summerbell |
| 2,150,914 | Mar. 21, 1939 | A. F. Gaidos |
| 2,019,383 | Oct. 29, 1935 | T. H. Dailey |
| 1,805,278 | May 12, 1931 | K. Danthine |
| 1,191,618 | July 18, 1916 | R. T. Saffold |
| 1,126,294 | Jan. 26, 1915 | R. T. Saffold |
| 1,009,161 | Nov. 21, 1911 | W. L. Marble |

-continued

| Pat. No. | Date Issued | Inventor |
|---|---|---|
| 798,866 | Sep. 5, 1905 | T. G. Bennett, et al |
| 732,540 | June 30, 1903 | G. H. Garrison |
| 439,543 | Oct. 28, 1890 | J. W. McCandless. |

Some of this art also discloses the interchangeability of barrels. However, none of this art is applicable to semiautomatic or automatic rifles or shotguns.

It is also well known to convert automatic pistols such as, for example, the "45 Colt" to fire smaller caliber ammunition or shot. See for example the following U.S. patents:

| Pat. No. | Date Issued | Inventor |
|---|---|---|
| 2,840,944 | July 1, 1958 | J. F. Thompson |
| 2,898,693 | Aug. 11, 1959 | W. B. Ruger |
| 3,504,594 | Apr. 7, 1970 | T. A. Greeley |
| 3,724,326 | Apr. 3, 1973 | R. W. Day |
| 3,657,959 | Apr. 25, 1972 | F. H. Kart |

These devices, with the exception of Thompson, all require the adaptation of the barrel as well as an additional mechanism below the barrel to adapt the pistol for smaller caliber ammunition. Thompson teaches the adaptation of the magazine for a shorter shell.

The use of "blow back" for semiautomatic and automatic rifles and shotguns is also well known in the art. See U.S. Pat. No. 2,290,156, issued July 21, 1942, to N. L. Brewer.

It is also well known in the art to adapt automatic and semiautomatic rifles and shotguns, including, for example, the M-16 and the AR-15, to the use of smaller caliber ammunition. See for example U.S. Pat. No. 3,771,415, issued Nov. 13, 1973, to H. A. Into, et al; German Pat. No. 1,093,265, issued Nov. 17, 1960, to J. G. Anschutz; and a publication entitled "Atchisson M-16 or AR-15 22LR Conversion Device Operation and Maintenance Manual" apparently published by Military Armament Corp. of Mariette, Georgia, a copy of which can be found in Art Group 220 (received Mar. 1, 1973) in Class 89, Subclass 29 (having no author or publication date). None of these devices, however, teach the use of a three member assembly for the bolt-/receiver assembly that is capable of mating, without careful precision construction, to replace the bolt carrier of the M-16/AR-15 rifle, including those that had been exposed to much wear, as well as permit the insertion of the standard size magazine, without the use of an integral spring and guide rod assembly.

SUMMARY DISCUSSION OF THE INVENTION

The present invention uses a very simple but highly effective design including a receiver, a bolt, and a recoil spring for insertion in replacement of the bolt carrier of an automatic or semiautomatic rifle or shotgun such as, for example, an M-16 or AR-15, to adapt to automatic and semiautomatic feeding of low caliber ammunition. The present invention also uses blow back for automatic feeding.

The receiver is provided with a positioning spring on the rear of the unit to force the assembly forward and compensate for any variation due to manufacturing tolerance of the rifle or shotgun.

The recoil spring assembly holds the entire assembly together and is positioned on the top of the adapter assembly between the receiver and the bolt for ease of assembly in manufacture. The barrel on the front of the receiver assembly is loosely pinned to the guide rail so that it may be free to move from side to side for accurate positioning within the rifle chamber to produce better accuracy. The cartridge ejector is located on a guide rail of the receiver assembly which cooperates with the cartridge holder of the bolt. The bolt assembly is provided with a lefthand extractor to better hold extracted cartridge cases and improve ejection.

The bolt includes a firing pin which is spring loaded to project beyond the rear of the bolt so as to act as a buffer on recoil stroke. A rib is located on the underside of the bolt so that the adapter bolt may be locked in the open position using the rifle's hold open latch. Also, the rear of the firing pin is located, and the rear of the bolt is cut so that the rifle hammer rotates only through a partial arc to strike the adapter firing pin.

A magazine assembly for conversion of the M-16 magazine is also included to feed lower caliber ammunition. The replacement magazine is insertable within the M-16 magazine. Moreover, no catch or latch is required with the adapter magazine because it is held in place by spring pressure from the regular rifle magazine forcing the adapter block at the top of the magazine under the feed lips of the regular rifle magazine. Additionally, the cartridge feed ramp in the magazine is an integral part of the magazine adapter block with no ramp required on the barrel.

BRIEF DESCRIPTION OF THE DRAWINGS

For a further understanding of the nature and objects of the present invention, reference should be had to the following detailed description, taken in conjunction with the accompanying drawings in which like parts are given like reference numerals and wherein:

FIG. 10) of the magazine adapter of the apparatus of the preferred embodiment of the present invention;

DETAILED DESCRIPTION OF THE PREFERRED EMBODIMENT

Introduction

The preferred embodiment of the caliber converter of the present invention may be used to convert M-16 or AR-15 rifles to use lower caliber ammunition where it is important that the converter operate in a reliable manner in automatic and semiautomatic modes with the rifle to feed and discharge lower caliber ammunition even where there are deviations in dimensions of the rifle because of manufacture tolerances and/or wear. A particularly important area of application of the present invention is in the conversion of M-16 rifles to use 0.22 caliber ammunition. However, it should be realized that the present invention could be applied to, for example, any application where it is desired to convert automatic or semiautomatic rifles and shotguns to lower caliber ammunition while permitting quick interchange of the adapter with the normal mechanism of the rifle or shotgun and achieving reliable performance.

In the preferred embodiment of the present invention, the conversion is accomplished through inserting an assembly consisting of receiver, bolt, and recoil spring sub-assemblies to replace the bolt carrier of the M-16 rifle. The ammunition is introduced into the M-16 through a magazine converter unit placed within the standard M-16 magazine.

Structure and Its Method of Use

Figure 1:
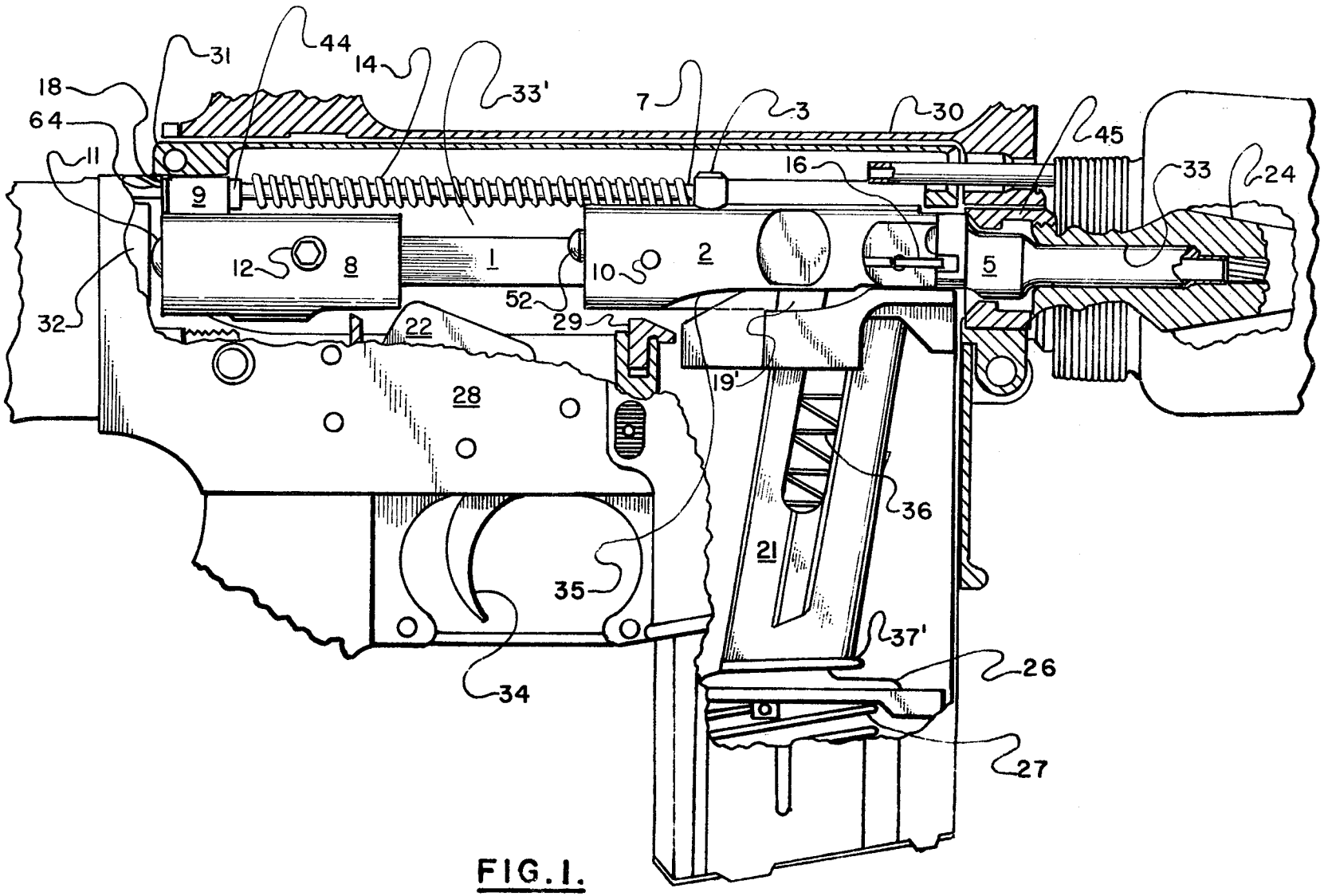
FIG. 1 is a partial side view, partially cut away, showing the entire assembly of the preferred embodiment of the present invention in place in an M-16 rifle.

Referring particularly to FIG. 1, there is shown the adapter assembly in place of the bolt carrier of the M-16 rifle and magazine assembly. The mechanism of the 0.22 rim fire adapter is blow back operated and is made up of three basic sub-assemblies, the adapter receiver 1, 8, comprised mainly of elements 5, 9, 3; the adapter bolt 2; and the recoil spring sub-assembly comprised of elements 44, 7 and 14.

The adapter bolt 2 is cylindrical in shape. Lips 46 and 47 thereon form a channel to receivingly, slidingly engage adapter receiver rail 1 (FIG. 7), which is a single side rail.

Figure 4:
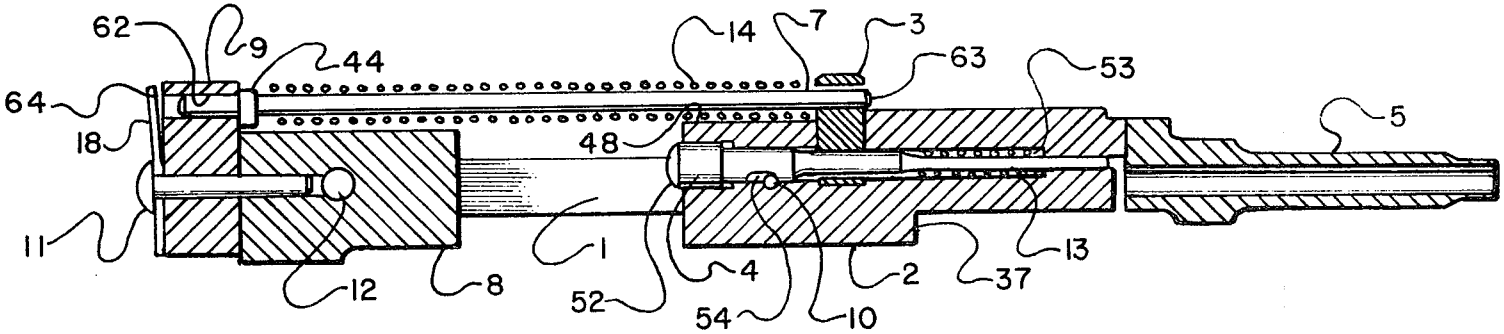
FIG. 4 is a side, cross-sectional view of the assembly of the preferred embodiment of the present invention taken along lines 4—4 of FIG. 3.

The top of bolt 2 comprises channel 48 (FIG. 4) sized to receive adapter recoil spring rod 7 and adapter recoil spring 14. Channel 48 terminates at adapter bolt lug 3 having a hole therethrough for receiving adapter recoil spring guide rod 7.

Therefore, rail 1 also locates the bolt 2 in proper angular position with the end of support lug 9 to be discussed subsequently.

Figure 3:
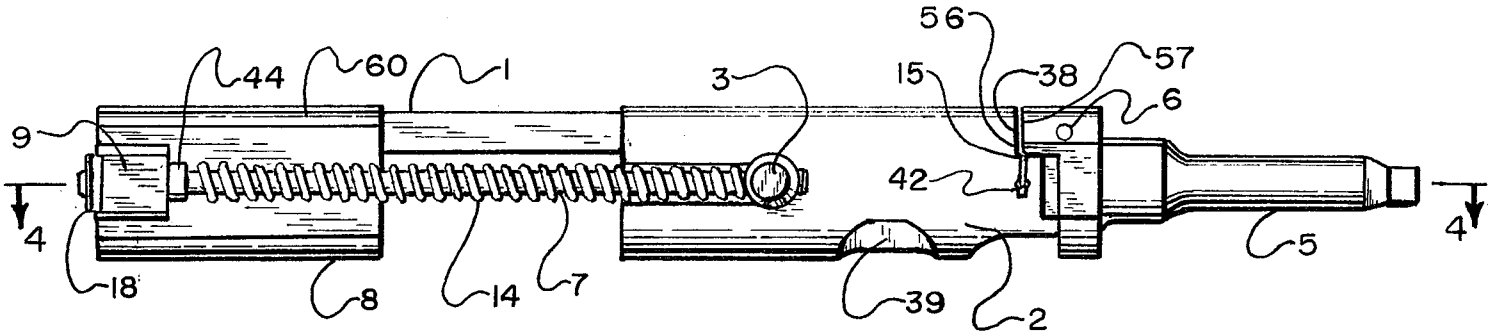
FIG. 3 is a top elevated view of the bolt replacement assembly of the preferred embodiment of the present invention, also showing the spring assembly expanded.
Figure 8:
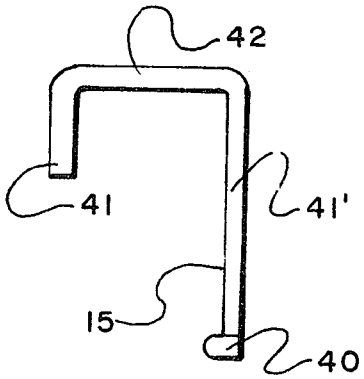
FIG. 8 is a detail, side view of the cartridge keeper of the preferred embodiment of the apparatus of the present invention.

As best shown in FIG. 3, adapter keeper 15 is mounted at the end of bolt 2 closest to adapter barrel 5 and on the side of bolt 2 closest to rail 1. Adapter keeper 15 is hook shaped having short end 41 (FIG. 8) receivingly mounted in a hole at the end of bolt 2 with top 42

(FIG. 3) mounted in a channel at the top of bolt 2. The long side 41 of adapter keeper 15 is mounted in a channel facing receiver rail 1 with protruding section 40 protruding into a slot 49 in adapter barrel 5. Keeper 15 acts as a cartridge keeper to apply pressure to the rim of the extracted cartridge case (not shown) and thus keep the rim of the case engaged with the extractor 16 until the case contacts the ejector 23 and is ejected as discussed subsequently. Very little space is left between the case rim and rail 1 requiring keeper 15 to be very thin. In order to attach keeper 15, the front to rear distance is kept short; it is bent up alongside the bolt 2, over the top and into a hole. Because it is constructed of spring wire, its own spring force holds it into the grooves in the side of bolt 2. Removal without tools is easy, requiring only lifting the front end 41 of keeper 15 out of its groove and sliding it out of the hole in the top of bolt 2. Flat spring steel instead of the round spring steel of the preferred embodiment could also be used in construction. The tail 42 of keeper 15 could also be brought over the top of bolt 2 and down the side of bolt 2 opposite rail 1 so that it replaces extractor 16 thus acting as an extractor spring and eliminating the need for the present extractor spring 51 and plunger 17 discussed subsequently.

On the side of bolt 2 opposite receiver rail 1 is machined groove 39 which is clearance cut for the lug on the dust cover of the M-16 rifle. The extractor assembly comprises adapter extractor 16 having hook 50 located opposite rear stop 55 at the end thereof for holding the rim of cartridges. It is rotatingly mounted on bolt 2 acting against bending extractor spring 51 by adapter extractor plunger 17 for forward raising.

At the lower end of bolt 2 is rib 35 having rib edge 37 (FIG. 4) as an integral part of bolt 2. It extends down far enough to allow holding the bolt in the open position by being adapted to make with rifle bolt hold opening latch 29 (FIG. 14) to hold the bolt 2 back and open when required by the M-16 operator by permitting the movement of bolt hold-open latch 29 of the rifle up to block the forward movement of bolt 2. This allows the shooter to lock bolt 2 open after firing showing that the magazine 21 is empty and the M-16 is safe. This also allows the loading of the M-16 in the same manner as one would while using the rifle without the adapter in its standard configuration with full powered ammunition. The loading of the M-16 is then accomplished by inserting a magazine, after the bolt 2 is in the hold open position, and then pressing the bolt hold open latch to release the bolt 2 so that it can move forward to feed and chamber a round as discussed subsequently. Latching on the bottom in this manner can only be accomplished if the adapter bolt 2 is open on the bottom in the area of hold open latch 29.

Figure 2:
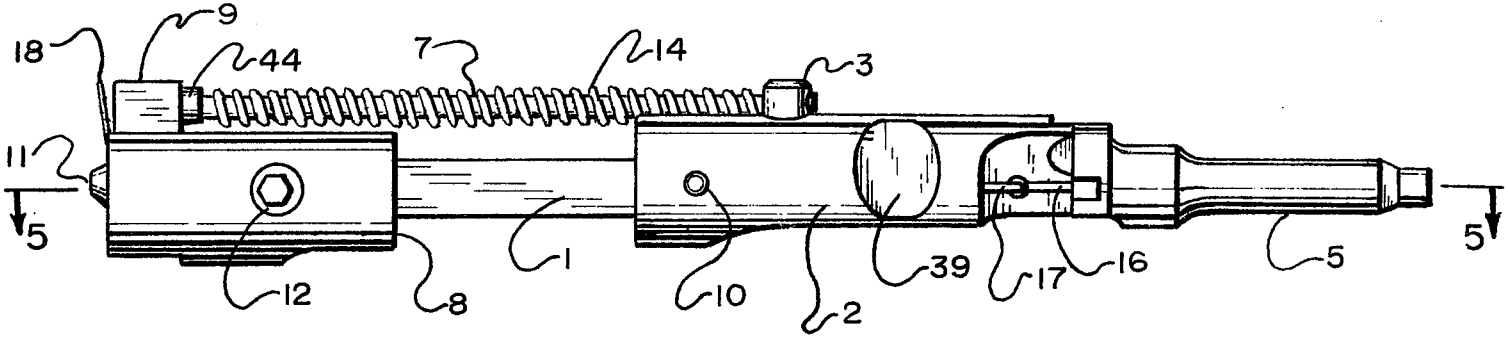
FIG. 2 is a side view of the replacement bolt assembly of the preferred embodiment of the apparatus of the present invention shown in the state with the spring expanded.
Figure 5:
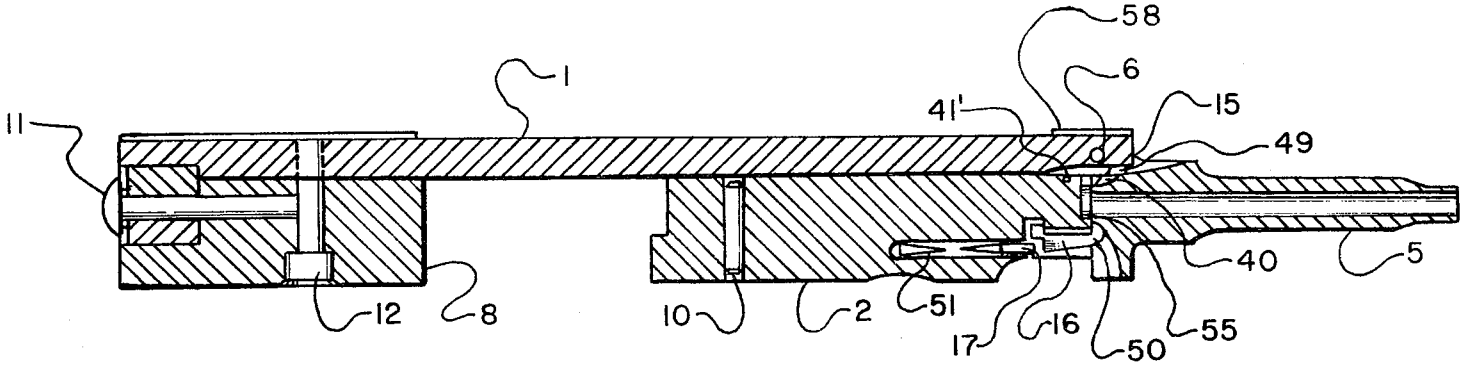
FIG. 5 is a top, cross-sectional view of the assembly of the preferred embodiment of the present invention taken along lines 5—5 of FIG. 2.

Reciprocally mounted within the center of bolt 2 is firing pin 4 having end 52 protruding at the end of bolt 2 opposite adapter rail support 8 (FIG. 2). Adapter firing pin 4 is of a tapered cylindrical shape having adapter firing pin retaining pin 10 (FIG. 5) holding the firing pin 4 within bolt 2. A heavy spring 13 (FIG. 4) is mounted in channel 53 to urge firing pin 4 toward the end of bolt 2 facing the adapter rail support 8. Adapter firing pin 4 retaining pin 10 is located in slot 54. Adapter firing pin 4 spring 13 being heavy in conjunction with the design of bolt 2 and firing pin 4 to permit firing pin 4 and 52 to protrude firing pin 4 to also serve as a buffer. Thus, when the bolt assembly 2 recoils to the rear, the firing pin 4 is the first to contact the supporting lug 8 discussed subsequently. Therefore, as the bolt continues to move rearward, the firing pin spring 13 is compressed and slows down the bolt 2 thus reducing its impact velocity and the damage to attached parts that might result from repeated high velocity impacts. Buffering of this sort could also be accomplished by the use of a separate spring loaded buffer or impact against a piece of resilient material such as plastic or rubber.

Figure 6:
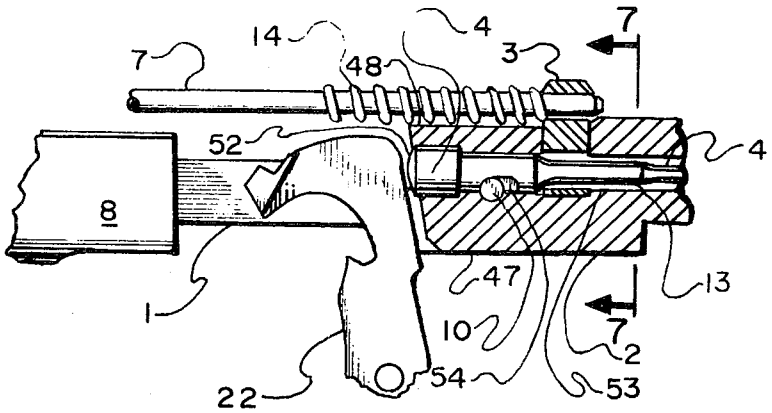
FIG. 6 is a partial, side view, partially cut-away and cross-sectioned, of the apparatus of the preferred embodiment of the present invention showing the relationship of the rifle hammer to the adapter bolt and firing pin.

The hammer 22 of the M-16 rifle, when used with the standard bolt and firing full powered ammunition, rotates to a full vertical position when striking the firing pin 4. This hammer action is too heavy and is powered by a spring with the capability of storing far more energy than needed to ignite the little 0.22 rim fire cartridge. This excess force also has to be overcome in recocking the hammer 22 and takes a great deal of energy from the adapter bolt 2 in doing so. To insure sufficient energy and velocity of recoil, energy loss by the adapter bolt 2 has to be minimized. Adapter bolt 2 is mounted at the end of receiver rail 1 at a position in cooperation with the rear end 52 of the adapter of adapter firing pin 4 so that the rifle hammer 22 rotates only through a partial arc as activated by trigger 34 to strike the adapter firing pin 4. By doing this, less energy is required to cock the hammer, resulting in improved unit reliability. This allows the hammer 22 to rotate enough to fire the 0.22 rim fire cartridge but not to full vertical position (note FIG. 6). In this manner, the hammer 22 is moved a shorter distance in cocking and thereby requires less energy from the bolt 2, which assures the hammer 22 being caught in the cocked position if sufficient energy is present to recoil the bolt a sufficient distance to feed another round into the chamber, thereby avoiding the problem of inadequate power being generated by the 0.22 cartridge. The reliable catching of hammer 22 assures that the M-16 rifle will not "double fire" by the hammer 22 riding forward and striking the newly chambered cartridge, thereby avoiding the necessity of positioning the magazine 21 far enough to the rear of the M-16 that a round cannot be fed unless the hammer 22 has been cocked which would create feed problems.

Adapter barrel 5 of the adapter receiver assembly is pinned to receiver rail 1 by pin 6. In this manner, the barrel 5 is loosely pinned to guide rail 1 having a positive rearward stop 55 but free to move from side to side so that the adapter barrel 5 can accurately position itself within the rifle chamber 33 along guide ring 45 to produce better accuracy. In this way, the adapter barrel 5 is free to seek a common center within the rifle chamber 33 and into rifle barrel 24 and yet not be affected by manufacturing or wear variations in the rail 1, barrel extension 45 or chamber 33 or the movement of rail 1 during firing. The shoulder 56 (FIG. 3) is machined on the rail 1 to match a surface 57 on the barrel 5 so that the front and rear location is controlled. In assembly, the front end of the receiver rail 1 fits into the mating slot formed by lips 58 (FIG. 5) in the barrel 5. The barrel 5 is then pinned to the rail with the pin 6 being a tight fit in the barrel 5 and a loose fit in the rail 1 with gap 38 (FIG. 3). By using this method manufacturing tolerances in the fit of the barrel 5 to the rail 1 may not be as close thereby reducing the over-all cost of the unit.

The adapter receiver sub-assembly portion 1, 5 includes a section of a circle for short barrel section 5 in the front which fits into the M-16 chamber 33 between rifle lower receiver 28 and rifle upper receiver 30, and a lug 9 at the rear thereof to locate it within the M-16 and prevent its rotary or linear motion as changing handle 31 is depressed as discussed subsequently. Adapter rail support 8 is mounted onto receiver rail 1 by adapter rail screw 12. This allows the adapter bolt sub-assembly to be assembled from the side. A positioning spring 18 is located on the rear of adapter rail support 8 extending the full height of the rear of adapter rail support 8 and adapter lug 9 is used to force the assembly forward forming spring space 64 in cooperation with adapter lug screw 11 mating with rifle buffer 32 and compensate for any variation in M-16 rifles due to manufacturing or wear tolerance especially variations in the distance between the chamber mouth of barrel extension 45 to the shoulder 56. Positioning spring 18 is secured to the rear of adapter rail support 8 by adapter lug screw 11. A coil spring with a plunger, of course, would be used instead of the preferred embodiment cantilever spring 18. Spring 18 forces the entire adapter assembly forward reliably positioning it within the barrel 33 before each shot thereby improving reliability in feeding and functioning. By using a spring 18 to compensate for this variation, the tolerance of the over-all length of the adapter assembly becomes less critical thereby reducing the manufacturing cost. The adapter assembly will, of course, operate without the spring, however, the exact location of the unit relative to the magazine 21 and hammer 22 cannot be predicted from shot to shot, and variations in the feeding and firing will occur with lower reliability resulting. Also, the adapter assembly could be locked into the rifle barrel extension 45. This requires additional expense for the machining of the adapter barrel 5 and complicates the design in that the adapter, or at least the adapter barrel 5, must be rotated to lock into the barrel extension 45 and provisions must be made to prevent it from rotating during the firing. Positioning spring 18 also acts as a buffer between the adapter assembly and the M-16 when the bolt 2 strikes the rail support 8, as previously discussed, at the end of the travel of bolt 2 recoil stroke.

Figure 7:
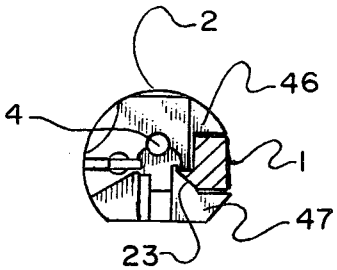
FIG. 7 is a front, cross-sectional view of the guide rail of the apparatus of the preferred embodiment of the present invention taken along section lines 7—7 of FIG. 6, showing the bolt face and the ejector.

Receiver rail 1 fits within a groove topped by lips 60 of short barrel section 8 (FIG. 3). Receiver rail 1 is also slidingly engaged to adapter bolt 2 by top rail support 46 and bottom rail support 47 (FIG. 7) as previously discussed. Adapter bolt 2 is held on receiver rail 1 by the adapter recoil spring 14 urging against adapter lug 3. Adapter bolt 2, or course, through its mounting on rail 1 is kept in proper angular position with the aid of support lug 9. Receiver rail 1 also has an integral ejector 23 (FIG. 7). Because ejector 23 is integral and the bolt 2 travels along the receiver rail 1, accurate location of the bolt 2 to ejector 23 is an easy matter. Therefore, receiver rail 1 acts both as a common assembly link, providing a guide rail for the movement of bolt 2, and serves to locate the ejector 23.

The recoil spring assembly is comprised of a guide rod 7 and a spring 14. The primary function of spring 14 is to return the bolt 2 to battery after firing, its secondary function, however, is to hold the guide rod 7 into a hole 62 in the adapter receiver lug 9 (FIG. 4), and in this position the guide rod 7 holds the receiver 8 and bolt 2 together as an assembly. Lug stop 44 located at the end of rod 7 spaces the amount of rod 7 in hole 62 and acts as a stop for the force of spring 14 in compression between lug stop 44 and adapter bolt lug 3. As previously discussed, rod 7 also feeds through hole 63 and adapter bolt lug 3. By mounting the recoil spring 14 above the bolt 2, only a simple hole in the rear lug 9 and the bolt lug 3 are required to contain the recoil spring and its guide rod 7 thereby applying the spring load to the bolt 2. The purpose of the spring 14 is to take energy from the bolt 2 during the recoil stroke, slowing the bolt 2 down to a stop in cooperation with firing pin 4 against support 8, and then returning this energy to the bolt 2 for the counter recoil stroke, in which the bolt 2 moves forward, and feeds and chambers a round (not shown) from the magazine 21.

As previously discussed, the spring guide rod 7 is held in place by spring pressure holding it into the hole 62 in support lug 9. The guide rod 7 then passes through the hole 63 in the bolt lug 3 to hold the bolt 2 on the receiver rail 1. This assembly is thereby simple, and requires only pulling the spring guide rod 7 out of the hole 62 and the support lug 9 (against the pressure of spring 14) and moving it to the side to release recoil spring 14 and bolt 2. Being above the bolt 2 and completely in the open, the spring 14 is not bothered by dirt or fouling which can fall through the spring 14, causing drag as would happen to a spring operating in a deep hole in the bolt.

Figure 13:
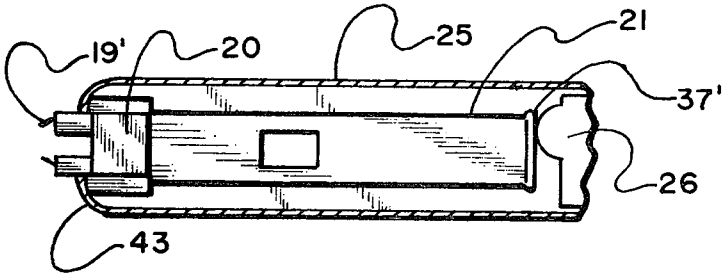
FIG. 13 is a partial, cross-sectional view of the magazine assembly of the apparatus of the present invention taken along section lines 13—13 of FIG. 9.
Figure 9:
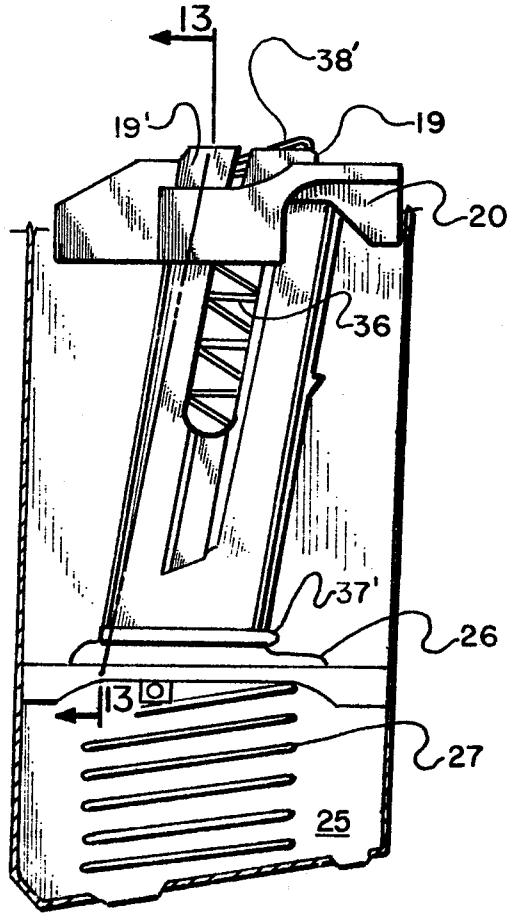
FIG. 9 is a cross-sectional view of the assembled magazine of the apparatus of the preferred embodiment of the present invention.
Figure 10:
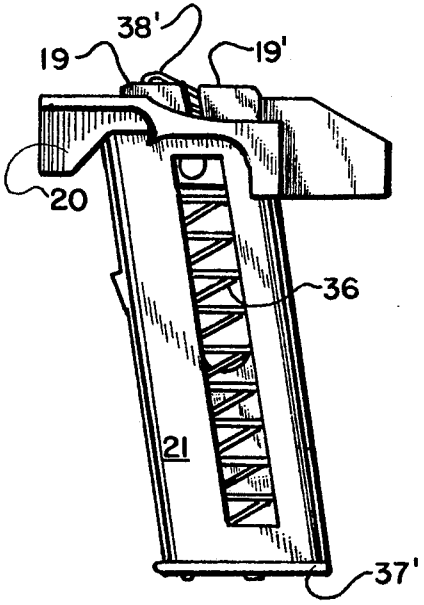
FIG. 10 is a side view of the magazine adapter of the preferred embodiment of the present invention.
Figure 12:
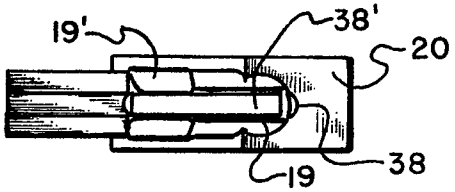
FIG. 12 is a plan view of the magazine adapter of the apparatus of the preferred embodiment of the present invention.
Figure 11:
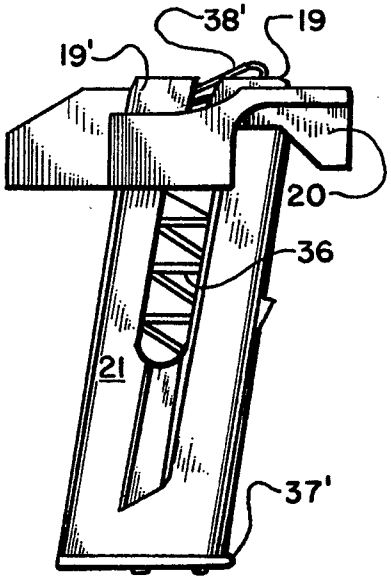
FIG. 11 is a view of the other side (cf.

Referring now to FIGS. 9, 10, 11, 12, and 13, the magazine 21 consists of a conventional ten shot magazine with follower ramp 38', follower spring 36 and floor plate 37'. Attached to the upper portion of magazine 21 is a block of metal 20 shaped in such a way as to hold the adapter magazine 21 into the M-16 magazine 25. The M-16 magazine 25 is a conventional box magazine with follower 26 and follower spring 27 with feed lips 43 (FIG. 13). Insertion of the adapter magazine 21 into the standard M-16 magazine 25 is accomplished simply by forcing the adapter magazine 21 down through the feed lips 43 of the M-16 magazine 25 and against the spring 27 force of the M-16 follower 26. Block 20 is so designed that it, as an assembly with the adapter magazine 21, can be slid back under the feed lips 43 of the rifle magazine 25. With the application of the force of the rifle magazine follower spring 27, through the follower 26 against the bottom 37' of the adapter magazine 21, the proper moments result to hold the adapter magazine 21 in place without the use of a latch or catch. This same spring pressure from the magazine follower spring 27 loads the adapter magazine 21 against the rest of the adapter assembly, thereby assuring the proper tolerances without regard to manufacturing tolerances, and overcomes difficulties arising from worn rifle magazine catches. This extra tolerance is accomplished because the adapter magazine 21 by the design of block 20 is allowed to project further out of the M-16 magazine 25 than required. The adapter magazine 21 is also provided with adapter cartridge keeper 19' and cartridge guide 19 in cooperation with adapter cartridge feed ramp/follower 38, 38', respectively, to give a more constant location of feed ramp relative to the magazine 21, resulting in more reliable feeding. In this manner no feed ramp is required on the barrel 5.

The entire assembly can be made of chrome moly steel.

The basic operation sequence for the adapter comprises inserting the adapter against rifle buffer 32 and into rifle chamber 33 with spring 18 compensating for any variation. The steps for the insertion comprise breaking down the M-16 rifle as per the standard maintenance procedure as well known in the art by pushing the take down pin to the right and tipping upper receiver up. The bolt carrier assembly is then removed. The 0.22 rim fire adapter is then inserted in place of the bolt carrier assembly making sure that the rifle dust cover is open. With the adapter inserted so as to be flush with the rifle receiver 30 and the hammer 22 of the rifle cocked, the rifle is closed and pushes the take down pin into the locked position.

A loaded magazine 21 inserted within the regular rifle magazine 25 is also inserted into the M-16 rifle. The adapter 21 of course is inserted into the normal magazine 25 of the M-16 rifle by forcing it against follower 26 until block 20 can be forced rearward under lips 43.

Figure 14:
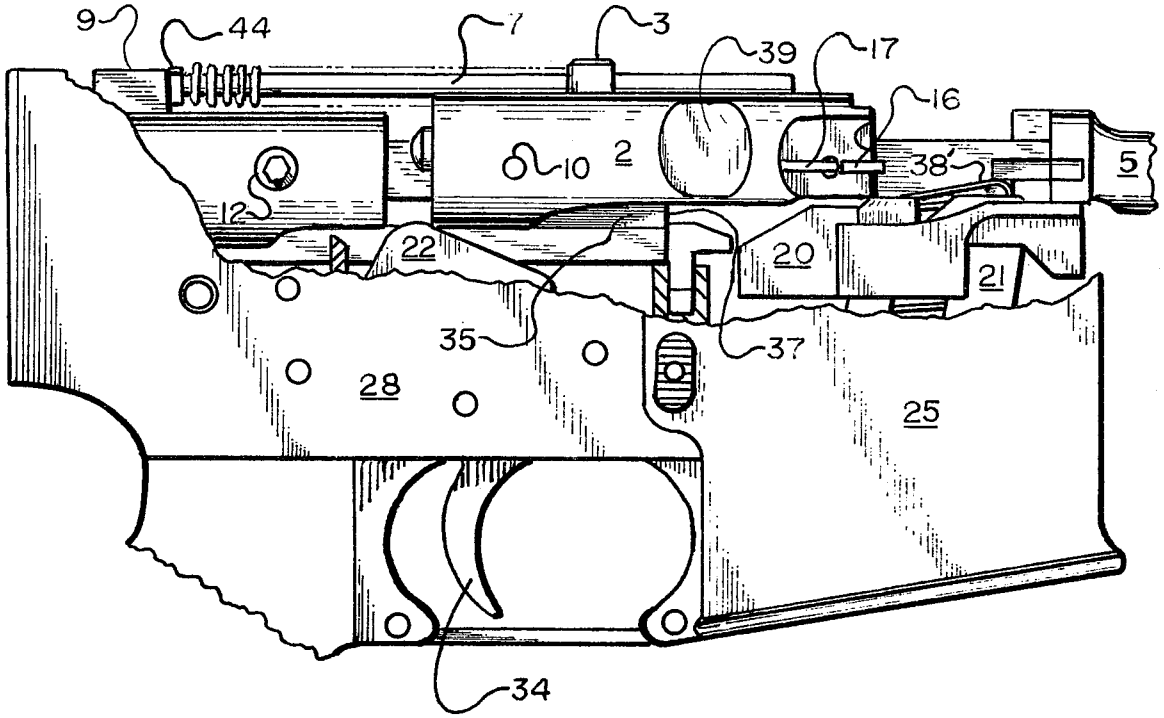
FIG. 14 is a partial, side view, partially cut away, of the apparatus of the preferred embodiment showing the adapter bolt in the open latched position.

As shown in FIG. 14, pulling back on the charging handle 31 draws the bolt 2 to the rear, compresses the recoil spring 14 and cocks the M-16 hammer 22. Bolt 2 can be held in this position if desired by rifle bolt hold open latch 29 as shown in FIG. 14. Releasing the charging handle 31 allows the bolt 2 to move forward, propelled by its recoil spring 14, feeding a cartridge (not shown) from the magazine 21 using feed ramp 38', chambering it, and snapping the extractor 16 over its rim. As the M-16's trigger 34 is pulled, the M-16 hammer 22 strikes the adapter's bolt 2 spring loaded firing pin 4 at end 52. This action drives firing pin 4 into the rim of the cartridge causing ignition. As the bullet moves down the barrel 5 and rifle barrel 24, the bolt 2 is driven up to the rear drawing with it the empty cartridge case (not shown) which is ejected out of the M-16 when it is struck by the ejector 23 in cooperation with ejector spring 15. Continuing recoil of the bolt 2 recocks the hammer 22 and bolt 2 final motion is stopped as end 52 impacts adapter receiver 8, cushioning impact with firing pin spring 13. The bolt 2 is then returned to its forward position by the force of the recoil spring 14. During its forward travel, the bolt 2 strips a fresh round from magazine 21 using feed ramp 38' and chambers it. Releasing and again pulling the M-16 trigger 34 or when it is automatic sequence will repeat the above sequence.

Although the system described in detail supra has been found to be most satisfactory and preferred, many variations in structure and method are, of course, possible. For example, any suitable building material may be used. Also, any spring loaded assembly may be used in place of cantilever spring 18. Also a separate spring loaded buffer, or impact against a piece of resilient material such as plastic or rubber, could be substituted for the cushioning of firing pin end 52 against receiver 8. Moreover, any shape spring steel may be used for adapter extractor spring 15.

The above are, of course, merely exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. In an adapter for converting a firearm adapted for automatic feed of ammunition to use different size ammunition, the firearm having a firearm receiver with a first and a second end and a firearm barrel extending from the second end, the adapter having a fixed adapter receiver with a first portion located at the first end of the firearm receiver and a barrel insert at the second end of the firearm receiver, the barrel insert extending into the fireman barrel, the first portion of the adapter receiver and its barrel insert having a connection therebetween, the improvement comprising:

a resilient spring mounted on the adapter receiver facing the first end of the firearm receiver biasing the adapter receiver away from the first end of the firearm receiver.

2. The adapter of claim 1 wherein there is further included:

connection means for loosely pinning the barrel insert to the adapter receiver for permitting the barrel insert to center in the firearm barrel.

3. The adapter of claim 2 wherein said connection means includes:

a rail on the adapter receiver having a hole therethrough; the barrel insert having a groove therein sized to receive said rail and having a hole therethrough;

a pin fitting through said holes with the pin having a tight fit with the barrel insert and a loose fit with said rail.

* * * * *

Notice of Adverse Decision in Interference

In Interference No. 100,221, involving Patent No. 4,098,016, J. P. Foote, AUTOMATIC AND SEMIAUTOMATIC SMALL CALIBER CONVERSION SYSTEM, final judgment adverse to the patentee was rendered June 23, 1983, as to claims 1, 2 and 3.

[*Official Gazette November 15, 1983.*]